US009659537B2

(12) United States Patent
Qin et al.

(10) Patent No.: US 9,659,537 B2
(45) Date of Patent: May 23, 2017

(54) LIQUID CRYSTAL DISPLAY DEVICE AND DRIVING METHOD THEREOF

(71) Applicant: Shenzhen China Star Optoelectronics Technology Co., Ltd., Shenzhen, Guangdong (CN)

(72) Inventors: Jiehui Qin, Guangdong (CN); Xiaoping Tan, Guangdong (CN); Wei Chen, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 157 days.

(21) Appl. No.: 14/425,047

(22) PCT Filed: Jan. 16, 2015

(86) PCT No.: PCT/CN2015/070855

§ 371 (c)(1),
(2) Date: Mar. 1, 2015

(87) PCT Pub. No.: WO2016/106866

PCT Pub. Date: Jul. 7, 2016

(65) Prior Publication Data

US 2016/0343316 A1 Nov. 24, 2016

(30) Foreign Application Priority Data

Dec. 31, 2014 (CN) ..... 2014 1 0854636

(51) Int. Cl.
*G09G 3/36* (2006.01)

(52) U.S. Cl.
CPC ..... *G09G 3/3614* (2013.01); *G09G 3/3648* (2013.01); *G09G 3/3677* (2013.01);
(Continued)

(58) Field of Classification Search
CPC .. G09G 3/3614; G09G 3/3677; G09G 3/3688; G09G 3/3696; G09G 2310/08; G09G 2320/0276; G09G 3/3648
(Continued)

(56) References Cited

U.S. PATENT DOCUMENTS 5,365,284 A * 11/1994 Matsumoto ..... G09G 3/3648 345/100
2003/0001810 A1* 1/2003 Yamaguchi ..... G09G 3/3648 345/87

(Continued)

FOREIGN PATENT DOCUMENTS

CN 102237066 A 11/2011
CN 102760398 A 10/2012

OTHER PUBLICATIONS

Fang et al., Translation of CN102237066, Nov. 9, 2011.*
Hou et al., Translation of CN102760398, Oct. 31, 2012.*
Office Acion, China Patent Office.

*Primary Examiner* — Dmitriy Bolotin
(74) *Attorney, Agent, or Firm* — Andrew C. Cheng

(57) ABSTRACT

The disclosure is related to a liquid crystal display device, including a liquid crystal display panel and a gamma generator including a first storage unit storing a group of positive or negative gamma voltage values and a second storage unit storing a group of negative or positive gamma voltage values. The gamma generator periodically obtains the group of the positive or negative gamma voltage values, or the group of the positive or negative gamma voltage values according to a control of a polarity inversion signal. The liquid crystal display panel displays an image according to the group of the positive and/or the group of the negative gamma voltage values. The difference between the disclosure and the current technique is that the cost is decreased effectively; meanwhile, the driving structure is simplified, a
(Continued)

wiring area is decreased and it is favorable for a narrow frame design.

8 Claims, 1 Drawing Sheet

(52) U.S. Cl.
CPC ..... *G09G 3/3688* (2013.01); *G09G 3/3696* (2013.01); *G09G 2310/08* (2013.01); *G09G 2320/0276* (2013.01); *G09G 2320/0673* (2013.01)

(58) Field of Classification Search
USPC ..... 345/204–214
See application file for complete search history.

(56) References Cited

U.S. PATENT DOCUMENTS

| | | | | |
|---|---|---|---|---|
| 2006/0114207 | A1* | 6/2006 | Lee | G09G 3/3648 345/89 |
| 2006/0256065 | A1* | 11/2006 | Jung | G09G 3/3685 345/100 |
| 2007/0001964 | A1* | 1/2007 | Lee | G09G 3/3614 345/96 |
| 2010/0245319 | A1* | 9/2010 | Park | G09G 3/3233 345/211 |

* cited by examiner

LIQUID CRYSTAL DISPLAY DEVICE AND DRIVING METHOD THEREOF

BACKGROUND

Technical Field

The disclosure is related to liquid crystal display technology field, and more particular to a liquid crystal display device and a driving method thereof.

Related Art

The evolution of photoelectric and semiconductor technology has also led to the flat panel display to flourish. Among the various flat panel displays, the liquid crystal display device (referred to as LCD) has become the mainstream product on the market because of many superior characteristics of high space utilization efficiency, low power consumption, no radiation, and low electromagnetic interference.

The LCD device generally includes a liquid crystal display panel and a back light module (referred to as BL). Because the liquid crystal display panel itself does not have the self-luminous characteristics, the backlight module must be configured under the liquid crystal display panel to provide a surface light source to the liquid crystal display panel, so the liquid crystal display panel may display the image through the surface light source provided by the back light module.

In the liquid crystal display device, each of the liquid crystal cells corresponds to a thin film transistor (abbreviated as TFT). The TFT can be controlled to switch each of liquid crystal cells, i.e., each of TFTs should be understood as a valve. The valve can be switched to control the level of brightness and darkness of the corresponding pixel cells. When the valve is open, the light may pass through the valve, and the bright pixel cells may be obtained; when the valve is close, the light may not pass through the valve, and the dark pixel cells may be obtained. Besides the switch function of the valve, the switching extent of the valve may also be controlled by the magnitude of the applied voltage. The grade of the light emitting strength of the pixel cells are controlled in accordance with the backlight strength to achieve the purpose of grayscale controlled by class.

The brightness and the penetration of the liquid crystal display device exist a certain relationship, and the penetration is related to the voltage applied on the pixel. Therefore, the brightness of the liquid crystal display device is related to the voltage on each of the pixels. Usually, the relationship between the voltage and the penetration may be shown by using the gamma curve.

In current technique, the gamma voltages are usually divided to two groups based on the common voltage VCOM, wherein the voltage greater than the common voltage VCOM is defined as the positive gamma voltage group, and the voltage smaller than the common voltage VCOM is defined as the negative gamma voltage group. The grayscales displayed on the liquid crystal display device are the same by using the two groups of gamma voltages symmetrized in the common voltage. FIG. 1 is a schematic view of the liquid crystal display device of the current technique. Refer to FIG. 1, when the liquid crystal display device of the current techniques displays an image, a gamma generator 150 generates the positive gamma voltages and the negative gamma voltages, and all of the positive gamma voltages and the negative gamma voltages are supplied to the data driver (Source IC) 120. The data driver 120 selects the corresponding gamma voltage from the positive gamma voltages and the negative gamma voltages provided by the gamma generator 150 according to a polarity inversion (POL) signal provided by the timing controller 110. Then the data analog voltages are gamma corrected by the selected gamma voltages, and then the gamma corrected data analog voltages are provided to the liquid crystal display panel 140. The data analog voltages are transformed from video digital signals (i.e. the data signal as shown in FIG. 1) received by the data driver 120 from the timing controller 110.

In order to transmit all the gamma voltages to the data driver 120, there are more traces connected to the data driver 120. For example, the group of positive gamma voltages includes ten positive gamma voltages and the group of negative gamma voltages includes ten negative gamma voltages. Thus the gamma driver 120 at least need twenty pins for the memory select pins, and the traces connected to the data driver 120 at least need twenty. Therefore, the driving structure is complex, the wiring area on the liquid crystal display panel is increased, and it is unfavorable for narrow frame design of the liquid crystal display device. Further more traces result in increase on the cost.

SUMMARY

In order to solve the above current technique problem, an object of the disclosure provides a liquid crystal display device comprising a gamma generator and a liquid crystal display pane. The gamma generator comprises a first storage unit and a second storage unit; the first storage unit stores a group of first gamma voltage values, and the second storage unit stores a group of second gamma voltage values. The first gamma voltage values are positive gamma voltage values, and the second gamma voltage values are negative gamma voltage values; alternatively, the first gamma voltage values are negative gamma voltage values, and the second gamma voltage values are positive gamma voltage values; according to a control of a polarity inversion signal, the gamma generator periodically obtains the group of the first gamma voltage values from the first storage unit, or the gamma generator periodically obtains the group of the second gamma voltage values from the second storage unit. The liquid crystal display panel displays an image according to the group of the first gamma voltage values and/or the group of the second gamma voltage values.

In one embodiment, the first storage unit further stores a first gamma value corresponding to the group of first gamma voltage values, and the second storage unit further stores a second gamma value corresponding to the group of second gamma voltage values; wherein the first gamma value equals to the second gamma value.

In one embodiment, the liquid crystal display device further comprises a timing controller; wherein the timing controller generates the polarity inversion signal.

In one embodiment, the liquid crystal display device further comprises a data driver; the data driver obtains a voltage of each of pixels on the liquid crystal display panel according to a digital signal provided by the timing controller and the group of the first gamma voltage values provided by the gamma generator or according to the digital signal provided by the timing controller and the group of the second gamma voltage values provided by the gamma generator, and the data driver transmits the voltage of each of pixels to the liquid crystal display panel.

In one embodiment, the gamma generator is a programmable gamma generator.

In one embodiment, the first storage unit and the second storage unit are non-volatile storage units.

Another object of the disclosure provides a driving method of a liquid crystal display device including the following steps: periodically obtaining a group of first gamma voltage values or a group of second gamma voltage values according to a control of a polarity inversion signal; displaying an image according to the group of the first gamma voltage values and/or the group of the second gamma voltage values; wherein, the first gamma voltage values are positive gamma voltage values, and the second gamma voltage values are negative gamma voltage values; or, the first gamma voltage values are negative gamma voltage values, and the second gamma voltage values are positive gamma voltage values.

In one embodiment, the group of first gamma voltage values corresponds to a first gamma value, and the group of second gamma voltage values corresponds to a second gamma value; wherein the first gamma value equals to the second gamma value.

In one embodiment, before the step of periodically obtaining the group of the first gamma voltage values or the group of the second gamma voltage values, the method further comprises a step of generating the polarity inversion signal.

In one embodiment, the step of displaying the image according to the group of first gamma voltage values and/or the group of second gamma voltage values comprises a step of performing a gamma correction for a data analog voltage using the group of the first gamma voltage values and/or the group of the second voltage values to generate a voltage of each of pixels of the liquid crystal display panel and providing the voltage of each of pixels to each of the pixels.

The difference between the liquid crystal display device and the driving method thereof of the disclosure and the current technique is that the memory select pins for the gamma generator are decreased and traces connected to the data driver are also decreased such that the cost is decreased effectively. Meanwhile, the driving structure of the liquid crystal display device is simplified, a wiring area on the liquid crystal display panel is decreased and it is favorable for narrow frame design of the liquid crystal display device.

BRIEF DESCRIPTION OF THE DRAWINGS

The above and other exemplary aspects, features and advantages of certain exemplary embodiments of the present disclosure will be more apparent from the following description taken in conjunction with the accompanying drawings, in which.

DETAILED DESCRIPTION

The following description with reference to the accompanying drawings is provided to explain the exemplary embodiments of the disclosure. It will be apparent, however, that the disclosure may be practiced by one or more embodiments, and the specific embodiments provided herein cannot be interpreted to limit the disclosure. On the contrary, those embodiments are provided to explain the principle and the application of the disclosure such that those skilled in the art may understand the various embodiments of the disclosure and the various modifications for specific expected application.

Figure 2:
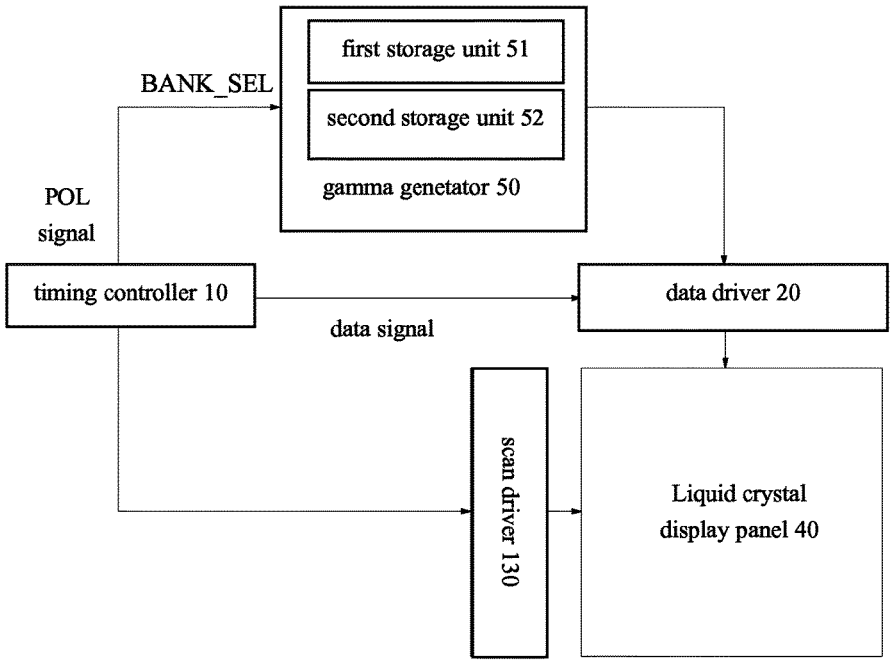
FIG. 2 is a schematic view of the liquid crystal display device according to the embodiment of the disclosure.

FIG. 2 is a schematic view of the liquid crystal display device according to the embodiment of the disclosure.

Refer to FIG. 2, a liquid crystal display device of the disclosure includes: a timing controller 10, a data driver 20, a scan driver 30, a liquid crystal display panel 40 and a gamma generator 50.

The timing controller 10 is used to generate a polarity inversion (POL) signal, and provide the POL signal to the gamma generator 50. In the embodiment according to the disclosure, the gamma generator 50 is a programmable gamma generator.

The gamma generator 50 includes a first storage unit 51, a second storage unit 52 and a hardware port BANK_SEL used for receiving the POL signal provided from the timing controller 10.

The first storage unit 51 is a non-volatile storage unit. The first storage unit 51 stores a group of first gamma voltage values and a first gamma value corresponding to the group of the first gamma voltage values; wherein the group of the first gamma voltage values includes a plurality of first gamma voltage values, for example ten first gamma voltage values. In this embodiment, the first gamma value may be 2.2, but the disclosure is not limited thereto.

The second storage unit 52 is a non-volatile storage unit. The second storage unit 52 stores a group of second gamma voltage values and a second gamma valued corresponding to the group of second gamma voltage values; wherein the group of the second gamma voltage values includes a plurality of second gamma voltage values, for example ten second gamma voltage values. In this embodiment, the second gamma value may be 2.2, but the disclosure is not limited thereto. In other words, the second gamma value equals to the first gamma value.

In the embodiment according to the disclosure, the first gamma voltage values are positive gamma voltage values; the second gamma voltage values are negative gamma voltage values. In other embodiments of the disclosure, it should be understood that the first gamma voltage values are negative gamma voltage values; the second gamma voltage values are positive gamma voltage values.

The gamma generator 50 periodically obtains the group of the first gamma voltage values from the first storage unit 51, or periodically obtains the group of the second gamma voltage values from the second storage unit 52 according to a control of a polarity inversion signal.

Specifically, the gamma generator 50 receives the POL signal provided by the timing controller 10 through the hardware port BANK_SEL. When the POL signal is high level, the first gamma value in the first storage unit 51 is obtained, and then the group of the first gamma voltage values are obtained according the first gamma value; and when the POL signal received by the hardware port BANK_SEL of the gamma generator 50 is low level, the second gamma value in the second storage unit 52 is obtained, and then the group of the second gamma voltage values are obtained according to the second gamma value. In other embodiments of the disclosure, it should be understood that when POL signal received by the hardware port BANK_SEL of the gamma generator 50 is low level, the first gamma value in the first storage unit 51 is obtained; and when POL signal received by the hardware port BANK_ SEL of the gamma generator 50 is high level, the second gamma value in the second storage unit 51 is obtained.

When the liquid crystal display device according to the disclosure applies a frame inversion to drive the pixels, a period of the POL signal is one time of a screen refresh period. That is, when the POL signal is high level, the screen displays one frame; and when the POL signal is low level, the screen displays another frame. The timing controller 10 controls the data driver 20 and provides a video digital signal (i.e. the digital signal as shown in FIG. 2) to the data driver 20. The data driver 20 receives the video digital signal provided by the timing controller 10, and transforms the video digital signal to a data analog voltage. Meanwhile, the data driver 20 receives the group of first gamma voltage values provided by the gamma generator 50 when the POL signal is high level, and perform a gamma correction for the data analog voltage using the group of the first gamma voltage values to generate a voltage of each of pixels on the liquid crystal display panel; or the data driver 20 receives the group of second gamma voltage values provided by the gamma generator 50 when the POL signal is low level, and perform a gamma correction for the data analog voltage using the group of the second gamma voltage values to generate a voltage of each of pixels on the liquid crystal display panel.

When the liquid crystal display device according to the disclosure applies a row inversion, a column inversion or a dot inversion to drive the pixels, a period of the POL signal equals to a screen refresh period. That is, a time of the POL signal maintained on the high level and a time of the POL signal maintained on the low level as well as a time of one frame displayed on the screen are the same. The data driver 20 receives the video digital signal provided from the timing controller 10 and transforms the video digital signal to the data analog voltage. Meanwhile, the data driver 20 receives the group of the first gamma voltage values provided from the generator 50 when the POL signal is high level and performs a gamma correction for the data analog voltage using the group of the first gamma voltage values to generate voltages of the positive polarity pixels on the liquid crystal display device, and the data driver 20 receives the group of the second gamma voltage values provided from the generator 50 when the POL signal is low level and performs a gamma correction for the data analog voltage using the group of the second gamma voltage values to generate voltages of the negative polarity pixels on the liquid crystal display device.

Figure 1:
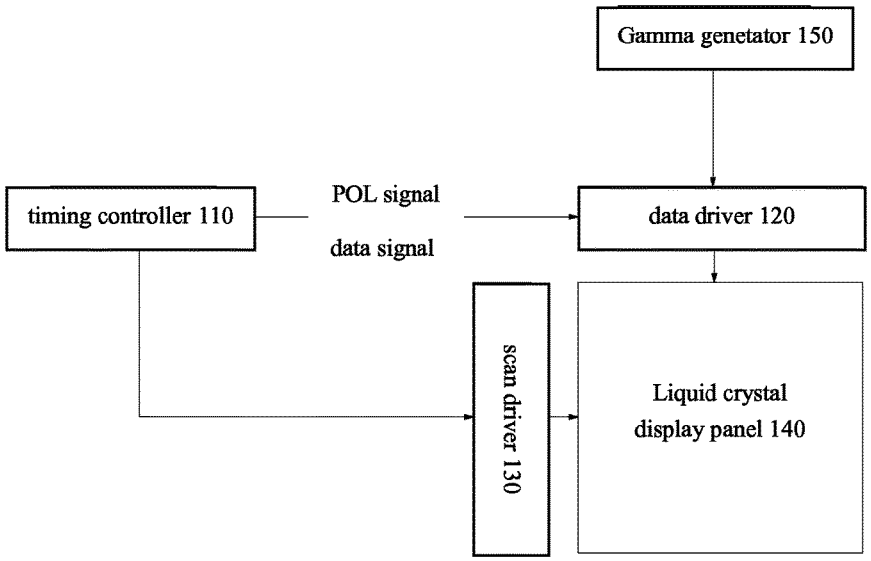
FIG. 1 (PRIOR ART)
FIG. 1 is a schematic view of the liquid crystal display device of the current technique.

For example, when the liquid crystal display device displays one frame, the gamma generator 150 of the current technique as shown in FIG. 1 needs to provide twenty gamma voltages (wherein, positive gamma voltages are ten, negative gamma voltages are ten) generated by the gamma generator 150 to the data driver 120. It means that the memory select pins set outside the gamma generator 150 at least needs twenty, and the traces connected to the data driver at least needs twenty. On the contrary, the gamma generator 50 of the embodiment of the disclosure selectively provides ten positive gamma voltages or ten negative gamma voltages to the data driver 20 according to the high level or low level of the POL signal. It means that the memory select pins set outside the gamma generator 150 only needs ten, and the traces connected to the driver 20 are also decreased to ten.

The timing controller 10 controls the scan driver 30 to activate a horizontal scans in accordance with the display time of each frame. The scan driver 30 is controlled by the timing controller 10 to sequentially provide the scan signals to the scan lines (not shown) on the liquid crystal display panel 40.

The liquid crystal display panel 40 receives the voltage of each of pixels provided by the data driver 20 and scan signals provided by the scan driver 30 and displays the image by the voltage of each of pixels provided by the data driver 20 and scan signals provided by the scan driver 30.

In summary, the difference between the liquid crystal display device and the driving method thereof of the disclosure and the current technique is that the memory select pins for the gamma generator are decreased and traces connected to the data driver are also decreased such that the cost is decreased effectively. Meanwhile, the driving structure of the liquid crystal display device is simplified, a wiring area on the liquid crystal display panel is decreased and it is favorable for narrow frame design of the liquid crystal display device.

Although the present disclosure is illustrated and described with reference to specific embodiments, those skilled in the art will understand that many variations and modifications are readily attainable without departing from the spirit and scope thereof as defined by the appended claims and their legal equivalents.

What is claimed is:

1. A liquid crystal display device comprising:

a gamma generator and a liquid crystal display panel; wherein the gamma generator comprises a first storage unit and a second storage unit; the first storage unit stores a group of first gamma voltage values, and the second storage unit stores a group of second gamma voltage values;

wherein the first gamma voltage values are positive gamma voltage values, the second gamma voltage values are negative gamma voltage values; or, the first gamma voltage values are negative gamma voltage values, the second gamma voltage values are positive gamma voltage values;

according to a control of a polarity inversion signal, the gamma generator periodically obtains the group of the first gamma voltage values from the first storage unit, or the gamma generator periodically obtains the group of the second gamma voltage values from the second storage unit;

the liquid crystal display panel displays an image according to the group of the first gamma voltage values and/or the group of the second gamma voltage values;

the first storage unit further stores a first gamma value corresponding to the group of the first gamma voltage values, and the second storage unit further stores a second gamma value corresponding to the group of the second gamma voltage values; wherein the first gamma value equals to the second gamma value.

2. The liquid crystal display device according to claim 1, wherein the liquid crystal display device further comprises a timing controller, the timing controller generating the polarity inversion signal.

3. The liquid crystal display device according to claim 2, wherein the liquid crystal display device further comprises a data driver, the data driver obtaining a voltage of each of pixels on the liquid crystal display panel according to a digital signal provided by the timing controller and the group of the first gamma voltage values provided by the gamma generator or according to the digital signal provided by the timing controller and the group of the second gamma voltage values provided by the gamma generator, and the data driver transmitting the voltage of each of pixels to the liquid crystal display panel.

4. The liquid crystal display device according to claim 1, wherein the gamma generator is a programmable gamma generator.

5. The liquid crystal display device according to claim 1, wherein the first storage unit and the second storage unit are non-volatile storage units.

6. A driving method of a liquid crystal display device, comprising:

periodically obtaining a group of first gamma voltage values or a group of second gamma voltage values according to a control of a polarity inversion signal;

displaying an image according to the group of the first gamma voltage values and/or the group of the second gamma voltage values;

wherein, the first gamma voltage values are positive gamma voltage values, the second gamma voltage values are negative gamma voltage values; or, the first gamma voltage values are negative gamma voltage values, the second gamma voltage values are positive gamma voltage values;

wherein the group of the first gamma voltage values correspond to a first gamma value, the group of the second gamma voltage values correspond to a second gamma value, wherein the first gamma value equals to the second gamma value.

7. The driving method according to claim 6, wherein before the step of periodically obtaining the group of first gamma voltage values or the group of second gamma voltage values, the method further comprises a step of generating the polarity inversion signal.

8. The driving method according to claim 6, wherein the step of displaying the image according to the group of the first gamma voltage values and/or the group of the second gamma voltage values comprises the step of performing a gamma correction for a data analog voltage using the group of the first gamma voltage values and/or the group of the second voltage values to generate a voltage of each of pixels of the liquid crystal display panel and providing the voltage of each of pixels to each of the pixels.

* * * * *